United States Patent [19]

Milh

[11] 4,413,454

[45] Nov. 8, 1983

[54] PREFABRICATED FRAME AND A MULTI-STOREY BUILDING INCLUDING SAID FRAME

[76] Inventor: Alfred-Henri Milh, 21 Rue de Longchamp, 75016 Paris, France

[21] Appl. No.: 270,396

[22] Filed: Jun. 4, 1981

[30] Foreign Application Priority Data

Jun. 5, 1980 [FR] France ..... 80 12524
Mar. 4, 1981 [FR] France ..... 81 04307

[51] Int. Cl.[3] ..... E04H 1/00

[52] U.S. Cl. ..... 52/236.6; 52/236.8; 52/436; 52/438

[58] Field of Search ..... 52/79.11, 79.14, 236.5, 52/236.8, 236.9, 251, 259, 436, 437, 439, 438

[56] References Cited

U.S. PATENT DOCUMENTS

| | | | |
|---|---|---|---|
| 2,645,114 | 7/1953 | Amirikian | 52/79.11 |
| 3,416,273 | 12/1968 | Stacky | 52/79.11 |
| 3,566,558 | 3/1971 | Fisher | 52/236 |
| 3,600,862 | 8/1971 | Eckert | 52/251 |
| 3,861,093 | 1/1975 | Robinson | 52/79.14 |
| 4,018,021 | 4/1977 | Dow | 52/251 |
| 4,019,293 | 4/1977 | Armas | 52/79.11 |
| 4,343,125 | 8/1982 | Shubow | 52/236.8 |

FOREIGN PATENT DOCUMENTS

| | | | |
|---|---|---|---|
| 2219202 | 10/1973 | Fed. Rep. of Germany | 52/236.9 |
| 2359831 | 6/1975 | Fed. Rep. of Germany | 52/236.9 |
| 1413828 | 8/1965 | France | 52/236.9 |
| 2282523 | 3/1976 | France | 52/79.11 |

*Primary Examiner*—John E. Murtagh
*Assistant Examiner*—Henry E. Raduazo
*Attorney, Agent, or Firm*—Wenderoth, Lind & Ponack

[57] ABSTRACT

The frame comprises two uprights having a generally trapezoidal cross-sectional shape and two rails. The upper rail has a U-section and the lower rail constitutes a solid beam which is capable of fitting in the U-section of the upper rail of a subjacent frame and of being rendered rigid with the latter and with adjacent flooring slabs by the pouring of a binder such as a high-early-strength concrete or a concrete containing resin. The upper rail of the subjacent frame defines with the corresponding upright a tongue which is capable of fitting in a groove defined between the lower rail and the corresponding upright of the upper frame.

15 Claims, 7 Drawing Figures

PREFABRICATED FRAME AND A MULTI-STOREY BUILDING INCLUDING SAID FRAME

DESCRIPTION

The present invention relates to a prefabricated reinforced concrete frame for the construction of buildings, the contour of the frame being defined by two uprights and two rails, in which the edge of each upright comprises rigid elements anchored in the concrete and constituting, or permitting the constitution of, projecting reinforcements which, in combination with corresponding reinforcements of at least one adjacent frame oriented at 90° or 180°, form at least a part of the iron-work of a reinforced concrete post for the assembly of the two frames.

Known frames of this type permit a connection of satisfactory rigidity between the uprights of adjacent frames, but their configuration is not fully satisfactory as concerns the assembly between the rails, and the assembly of the rails with the flooring slabs, of superimposed frames for the construction of a multi-storey building. Further, known solutions to this problem result in difficulties as concerns the relative positioning and the adjustment of the frames in the course of their assembly.

An object of the invention is to overcome the aforementioned drawbacks by means of an arrangement of the frames which is such that their positioning is simplified and the structures of multi-storey buildings resulting from their assembly have an exceptionally high rigidity which in particular enables them to resist earth tremors corresponding to a high value in the scale of Richter (9 to 10).

The invention provides a frame wherein the upper rail of the frame has a generally U-shaped cross-section in which can be inserted with clearance the lower rail of a superjacent frame, said lower rail being constituted by solid beam, and each upright has at its respective ends two planar and horizontal end faces each of which is set back with respect to the edge of the corresponding rail, the lower end face being adapted to bear against, by the effect of gravity, the upper end face of the upright of a subjacent frame.

With this arrangement, it is possible to arrange the lower end of an upright to define a groove and arrange the part of its upper end which is between the two sides of the U-section so as to define a tongue so that it is possible to fit the two lower grooves of a frame around the upper tongues of a subjacent frame which permits easily positioning the two frames with respect to each other in their plane and to obtain, owing to the fitting together, an increase strength or resistance. The interpenetration of the two adjacent rails also contributes to this strength, it being possible to arrange that these rails be, in their final position, rigidly interconnected and, if desired, connected with prefabricated flooring slabs each of which has an edge bearing against the edge of a side of the U-section, preferably by means of a pouring of resin concrete which fills the entire volume left free inside the U around the solid beam constituting the lower rail up to the level of the upper face of the slabs with a coating of the reinforcements projecting from the edge of the slabs.

In order to facilitate the relative positioning of superimposed frames in the transverse direction, it is advantageous to provide, in one of the horizontal end faces of each upright, a vertical pin and, in the other end face of the upright, a corresponding aperture which may be of oval section or oversized for receiving the pin of an adjacent upright. The oval-shaped aperture is preferably formed in the upper end face so that it is possible to pour into this aperture, immediately before placing the superjacent frame in position, an amount of liquid adhesive which is such that the penetration of the corresponding pin causes the adhesive to overflow and spread over the end face in which the aperture is provided whereby after the two frames have been adjusted with respect to each other, the hardening of the adhesive holds the two frames stationary in the position given thereto.

Vertical pins are also anchored in the bottom of the U-section, to which pins correspond vertical apertures, which are also of oval shape or overdimensioned, in the lower rail for receiving the pins of a subjacent frame whose length is such that they extend above the two rails fitted together so as to partly combine with the junction iron-work of the corresponding flooring slabs.

An intermediate upright unequally dividing the space between the two contour uprights is advantageously provided in the frame according to the invention so as to increase the rigidity of the latter. This increase in rigidity is rendered maximum in a structure resulting from the assembly of a plurality of frames, by an offset or staggered arrangement of the intermediate uprights.

The invention will be described merely by way of example in the ensuing description with reference to the accompanying drawings in which.

Figure 1:
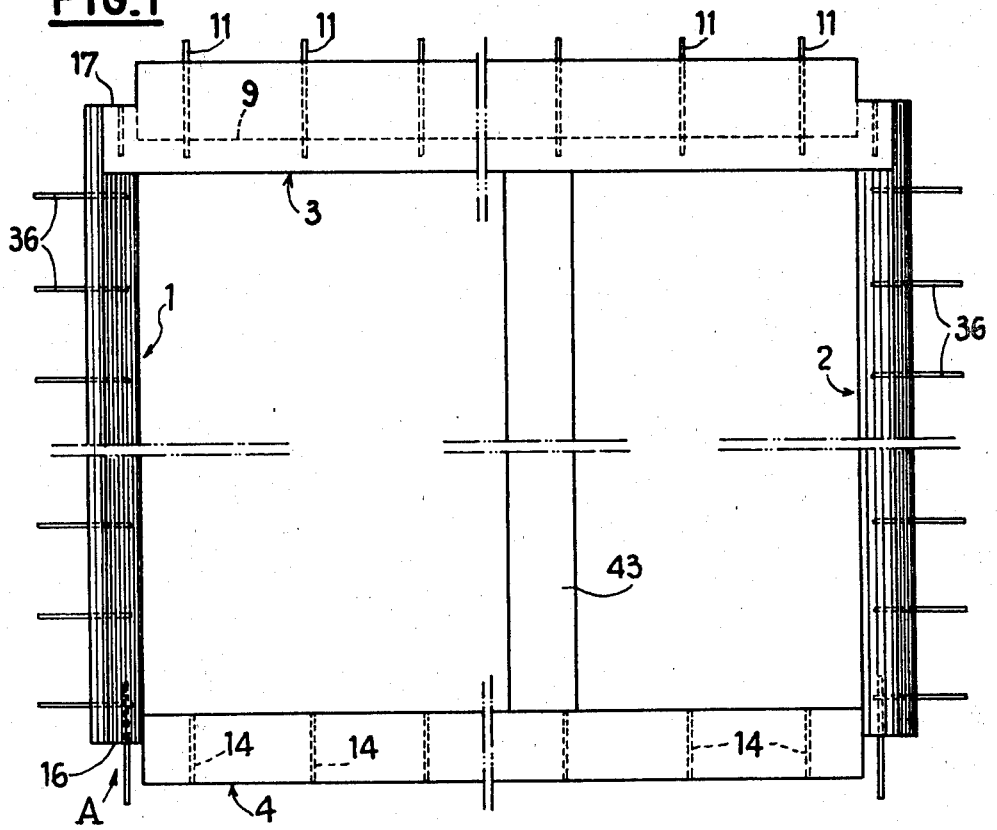
FIG. 1 is an elevational view of a frame according to the invention.

The prefabricated reinforced concrete frame A shown in elevation in FIG. 1 comprises two contour uprights 1, 2 and two rails 3, 4 which are respectively an upper and a lower rail. The upper rail 3 has a U-shaped section 5 defined by two sides 6 having vertical and parallel planar faces 7, 8 and a horizontal base 9 in which are anchored vertical pins 11 which are equally spaced apart and have their upper end portion projecting above the edge 6*a* of the sides 6. Corresponding to these pins in the lower rail 4, which forms a solid prismatic beam of rectangular sectional shape having planar vertical and parallel faces 12, 13, are vertical apertures 14 which are of oval shape or overdimensioned in which the pins 11 of a subjacent frame A are engageable, the lower rail 4 of the upper frame being inserted in the groove of the U-section 5.

Figure 6:
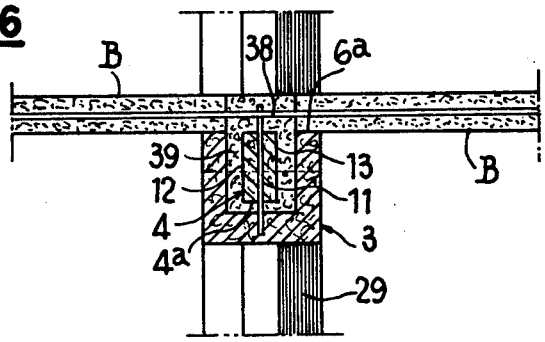
FIG. 6 is a vertical cross-sectional view of two adjacent rails of superimposed frames.

In this position of interpenetration of two adjacent rails (FIG. 3), one lower planar and horizontal end face 16 of each upright 1, 2 of a frame A, bears against a planar and horizontal upper end face 17 of the upright 1 or 2 of the subjacent frame A. Correlatively, the vertical distance between the lower end face 16 and the edge 4*a* of the corresponding lower rail 4, is less than the vertical distance between the upper end face 17 and the base 9 of the U-section so that, in the position of interpenetration of the rails 3 and 4 of two superimposed frames, there is an appreciable free space 18 between the base 9 of the U-section and the edge 4*a* of the lower rail (FIGS. 3 and 6).

Figure 2:
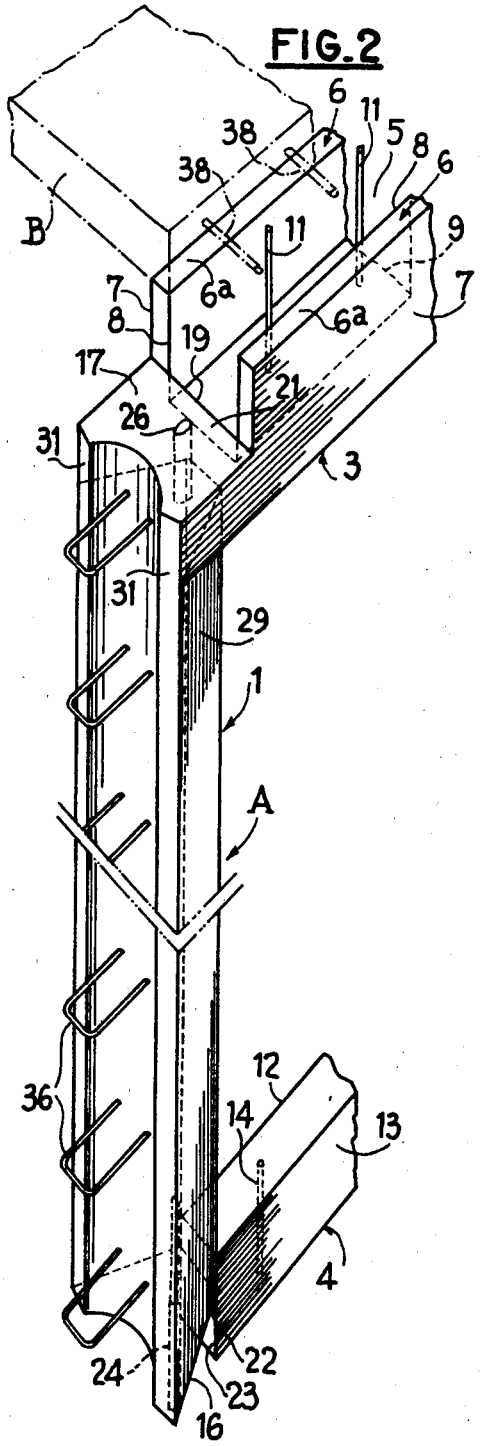
FIG. 2 is a perspective view of a contour upright of the frame, showing the shape of the upper and lower rails.
Figure 3:
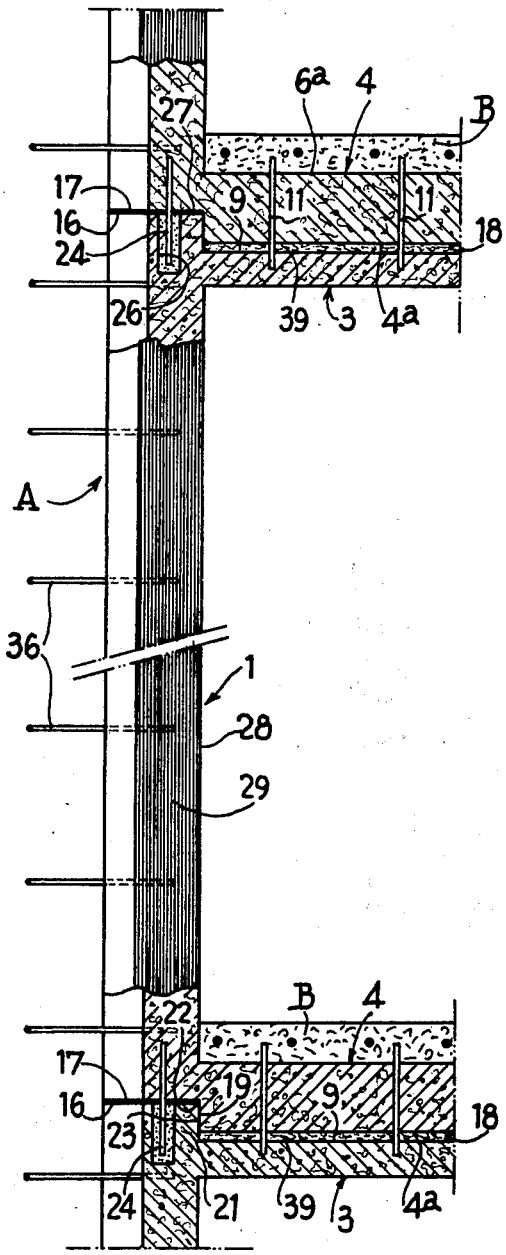
FIG. 3 is a partial sectional view, in the their median plane, of a plurality of superimposed frames of a multi-storey construction.

As is clear from FIGS. 2 and 3, the upper horizontal end face 17 of the uprights 1 and 2 defines with an adjacent vertical surface 19, which coincides with the end of the upper rail 3, a rib or tongue 21, and a groove 22 is formed by the lower horizontal end face 16 and by an adjacent vertical surface 23 which coincides with the end of the lower rail 4. In the assembled position of two superimposed frames A, the tongue 21 of one frame is fitted in the groove 22 of the superjacent frame and this contributes to the safety and rigidity of the assembly.

In order to facilitate the relative positioning of the two superimposed frames, a vertical pin 24 is anchored in the lower end face 16 of each upright. Corresponding thereto in the upper end face 17 is an aperture 26 which has an oval section or is overdimensioned, in which engages the pin 24 of a superjacent frame when the latter is placed in position. According to the invention, an amount of liquid adhesive is poured into the aperture 26 which is such that the penetration of the pin 24 causes the overflow of this adhesive which spreads over the the top of the end face 17 a layer of adhesive 27, which, after the adjustment allowed by the overdimensioning of the aperture 26, hardens and locks the two frames in their relative position.

Each upright 1, 2 forms a prismatic element of approximately trapezoidal sectional shape defined by a small base 28 (FIG. 5), which defines the inner opening of the frame and coincides with the transverse dimension of the lower rail 4, and by two sides 29 which are symmetrically disposed relative to the median plane of the frame and are outwardly divergent to two points 30 located in alignment with the outer faces 7 of the upper rail 3, thereby forming with two bevelled faces 31, which are also symmetrical and are oriented at 45° relative to the median plane, two heels or shoulders 32 between which a connecting arc of a circle 33 extends. The thickness of the uprights consequently increases in the outward direction and ensures the transition between the thickness of the lower rail 4 and the greater thickness of the upper rail 3.

Figure 4:
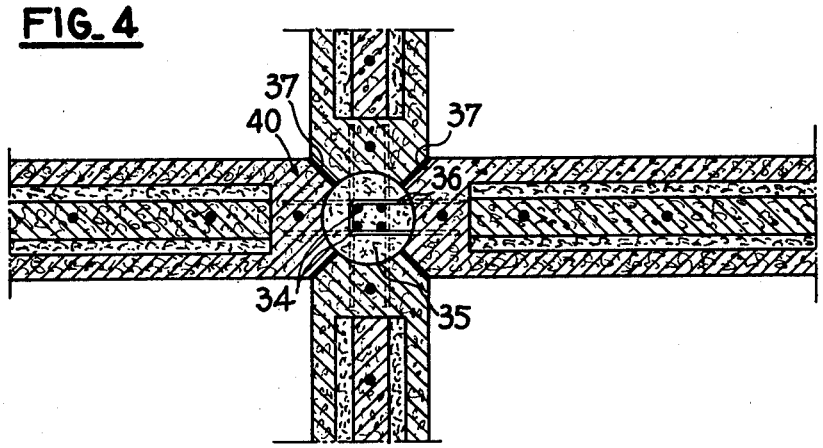
FIGS. 4 and 5 are horizontal sectional views of an assembly joint of four frames arranged in a cross configuration.
Figure 5:
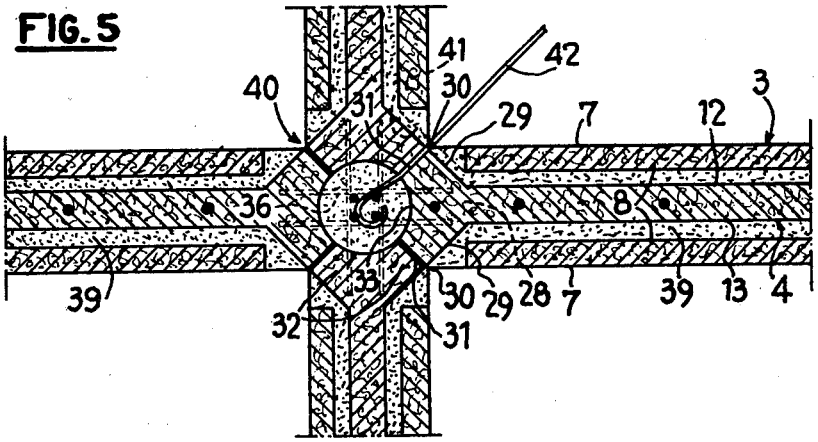

In the assembly in the form of a cross configuration of four frames disposed at 90° to each other shown in FIGS. 4 and 5, the four adjacent uprights form a joint whose central part constitutes a hollow column in which is poured cement concrete 35 after vertical reinforcements 34 are placed inside the stirrup elements 36 anchored in the grooves of the uprights corresponding to the arcs 33, this concrete forming with the uprights a rigid pillar 40. The concrete also fills the gaps 37 formed between the bevelled faces 31 to allow an adjustment of the position of the frames.

As suggested in FIGS. 2 and 6, a prefabricated slab B is normally placed in position at all the levels of the building inside each cell defined by four frames A disposed in a square configuration. Each of the edge portions of the slab bears against the edge 6*a* of a corresponding side 6 of an upper rail 3 and reinforcements 38 extending out of the edge of the slabs form with the projecting end portions of the pins 11 anchored in the upper rail, iron-work in which is poured epoxy resin concrete 30 which fills the free space formed inside the U-section 5 around the lateral faces 12, 13 and the lower face 4*a* of the lower rail 4 (inserted in the section 5) of the superjacent frame. It is also possible to provide in the region of bevelled faces 41 of each slab formed in confronting relation to the assembly joint of corresponding uprights, a projecting diagonal reinforcement 42 which completes the iron-work of the concrete 35 of the pillar 40.

Figure 7:
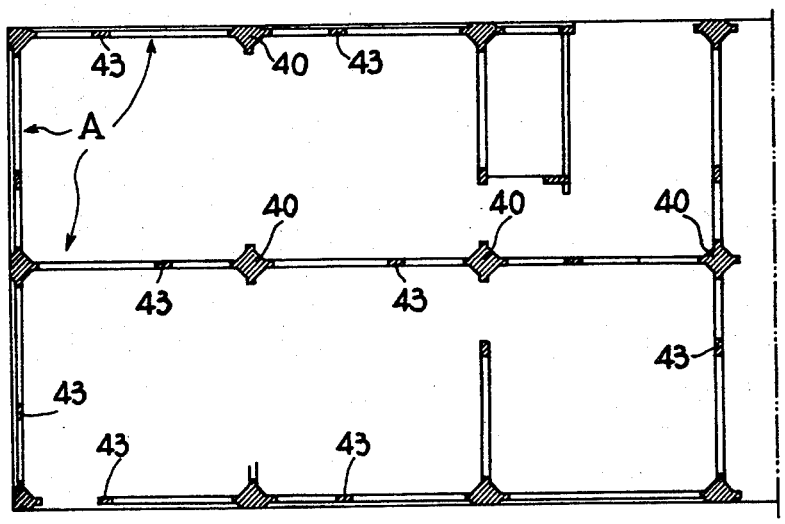
FIG. 7 is a plan view of an apartment of a building whose structure is constructed by means of frames according to the invention.

It is advantageous to provide in each frame A an intermediate upright 43 (FIGS. 1 and 7) which unequally divides the opening defined between the contour uprights 1, 2. In the diagrammatic plan view of an apartment constructed in accordance with the invention shown in FIG. 7, it can be seen that, as far as possible, the intermediate uprights 43 are offset from each other or arranged in staggered relation.

It will be clear that it is possible, if the adjustment of superimposed frames in height so requires, to interpose a spacer layer of a suitable material between the end faces 16, 17 which bear against each other of the respective uprights.

Instead of a single vertical pin 24 anchored in the manner described hereinbefore in an end face 16 or 17 of the uprights, two or more pins may be provided.

The resin concrete designated by the reference number 39 in the description may be replaced by a high-early-strength concrete of a different type.

Having now described my invention, what I claim as new and desire to secure by Letters Patent is:

1. Prefabricated reinforced concrete frame for the construction of buildings, the frame having a contour edge defined by two uprights and two rails, each upright having an edge which comprises rigid elements anchored in the concrete and constituting projecting reinforcements which, in combination with corresponding reinforcements of at least another adjacent frame oriented at 90° or 180° to the frame, form at least a part of reinforcing ironwork of a reinforced concrete post for the assembly of two frames, the upper rail of the frame having a generally U-section defining two side walls and a bottom wall, in which U-section can be inserted with clearance the lower rail of another superjacent frame, said lower rail being formed by a solid beam, each upright having at both of the ends thereof planar and horizontal end faces, each of which end faces being set back relative to an edge of an adjacent one of said rails, which edge is part of said contour edge of the corresponding frame, the lower end face of the upright being adapted to bear, under the effect of the force of gravity, against the upper end face of the upright of another subjacent frame.

2. A frame according to claim 1, wherein the upper horizontal end face of each upright defines with an adjacent vertical planar surface formed between the two side walls of said U-section, a tongue adapted to fit in a groove of another superjacent frame, which groove is defined by the lower horizontal end face of the corresponding upright and an adjacent vertical planar surface which coincides with the corresponding end of the lower rail.

3. A frame according to claim 1 or 2, wherein the distance between the lower end face of an upright and the corresponding edge of the lower rail is less than the distance between the bottom wall of said U-section of the upper rail and the upper end face of the upright.

4. A frame according to claim 1 or 2, wherein one of the end faces of an upright has anchored therein at least one vertical pin, to which pin corresponds a vertical aperture which has an oval shape and is provided in the opposite end face of the upright.

5. A frame according to claim 1 or 2, wherein one of the end faces of an upright has anchored therein at least one vertical pin, to which pin corresponds a vertical aperture which is overdimensioned relative to the vertical pin and is provided in the opposite end face of the upright.

6. A frame according to claim 1, wherein each upright forms a prismatic structure having a substantially trapezoidal cross-sectional shape defined by two oblique outwardly divergent planar faces having edges which respectively coincide with vertical faces of the lower rail and with outer vertical faces of said two walls of the U-section of the upper rail.

7. A frame according to claim 6, wherein said two oblique planar faces are extended by two bevelled faces which are oriented at 45° relative to a median plane of the frame, a groove of part-circular section is formed between said bevelled faces and stirrup reinforcement members extend from said part-circular groove.

8. A frame according to claim 1 or 2, comprising vertical pins anchored in said bottom wall of said U-section of the upper rail and extending beyond upper edges of said side walls of the U-section, and vertical apertures in the lower rail which correspond to said vertical pins in said bottom wall of said U-section and have an oval section.

9. A frame according to claim 1 or 2, comprising vertical pins anchored in said bottom wall of said U-section of the upper rail and extending beyond upper edges of said side walls of the U-section, and vertical apertures in the lower rail which correspond to said vertical pins in said bottom wall of said U-section and are overdimensioned relative to said vertical pins.

10. A frame according to claim 1 or 2, comprising an intermediate upright unequally dividing a space defined between the two contour uprights of the frame.

11. A prefabricated reinforced concrete frame in combination with a floor slab for constructing structures employed in the construction of buildings, the frame having a contour edge defined by two uprights and two rails, each upright having an edge comprising rigid elements anchored in the concrete and constituting projecting reinforcements which, in combination with corresponding reinforcements of at least another adjacent frame oriented at 90° or 180°, form at least a part of reinforcing ironwork of a reinforced concrete post for the assembly of the two frames, the edges of the frames constituting at least partly shuttering for pouring the concrete of the post, vertical pins being anchored in the upper rail and projecting upwardly so as to enter vertical apertures in the lower rail of another superjacent identical frame, said floor slab having an edge portion which is supported by an edge portion of the upper rail and having reinforcements which project horizontally from the floor slab and are combined with said vertical pins and form at least a part of a joint reinforcing ironwork between the slab and the adjacent frame.

12. A frame in combination with a floor slab according to claim 11, wherein each contour upright has in cross-section a portion having a trapezoidal shape defined by outwardly divergent faces defining two shoulders which are symmetrically disposed relative to a median plane and located on each side of a central groove formed in an edge of the upright.

13. In a multi-storey building constructed by means of frames, each of which frames having a contour edge defined by two uprights and two rails, each upright having an edge which comprises rigid elements anchored in the concrete and constituting projecting reinforcements which, in combination with corresponding reinforcements of at least another adjacent frame oriented at 90° or 180° to the frame, form at least a part of reinforcing ironwork of a reinforced concrete post for the assembly of two frames, the upper rail of the frame having a generally U-section defining two side walls and a bottom wall, in which U-section can be inserted with clearance the lower rail of another superjacent frame, said lower rail being formed by a solid beam, each upright having at both of the ends thereof planar and horizontal end faces, each of which end faces being set back relative to an edge of an adjacent one of said rails, which edge is part of said contour edge of the corresponding frame, the lower end face of the upright being adapted to bear, under the effect of the force of gravity, against the upper end face of the upright of another subjacent frame, said post between adjacent frames being poured on the site with the corresponding uprights of the adjacent frames forming shuttering: the improvement wherein a free space defined inside the U-section of the upper rail of a frame around the lower rail of a superjacent frame is filled with a concrete which surrounds reinforcing ironwork formed by reinforcements which project from edges of flooring slabs which bear on the respective side walls of the U-section of the upper rail and by projecting end portions of pins anchored in said bottom wall of said U-section of the upper rail.

14. A building according to claim 13, wherein said concrete filling said space includes a resin.

15. A building according to claim 13, comprising a layer of adhesive interposed between the horizontal end faces of two uprights of superimposed frames, said end faces bearing against each other through said layer of adhesive.

* * * * *